US006253809B1

(12) United States Patent
Paradies

(10) Patent No.: US 6,253,809 B1
(45) Date of Patent: Jul. 3, 2001

(54) BOTTLE FILLING ASSEMBLY WITH A SCREW LOADER HAVING A SPATIAL GROOVE

(75) Inventor: Gilbert E. Paradies, Satellite Beach, FL (US)

(73) Assignee: Crown Simplimatic Incorporated, Lynchburg, VA (US)

( * ) Notice: Subject to any disclaimer, the term of this patent is extended or adjusted under 35 U.S.C. 154(b) by 0 days.

(21) Appl. No.: 09/552,763

(22) Filed: Apr. 18, 2000

(51) Int. Cl.[7] ..... B65B 1/04
(52) U.S. Cl. ..... 141/372; 141/144; 141/170
(58) Field of Search ..... 141/372, 129–152, 141/168, 170

(56) References Cited

U.S. PATENT DOCUMENTS

| | | | |
|---|---|---|---|
| 2,259,748 | 10/1941 | Hullhorst . | |
| 2,571,036 | 10/1951 | Heyne et al. . | |
| 2,854,125 | 9/1958 | Johnson | 198/104 |
| 3,771,574 | 11/1973 | Creed et al. | 141/1 |
| 3,783,777 | 1/1974 | Killen et al. | 101/40 |
| 3,860,104 | 1/1975 | Strauss | 198/240 |
| 4,013,497 | 3/1977 | Wolf | 156/154 |
| 4,033,804 | 7/1977 | Baldyga | 156/84 |
| 4,325,775 | 4/1982 | Moeller | 156/584 |
| 4,599,131 | 7/1986 | Matuszak | 156/584 |
| 4,660,708 | 4/1987 | Willerding | 198/341 |
| 4,661,195 | 4/1987 | Hopson | 156/344 |
| 4,715,920 | 12/1987 | Ruppman et al. | 156/344 |
| 4,717,442 | 1/1988 | Hopson | 156/584 |
| 4,817,683 | 4/1989 | Laub, III et al. | 141/1 |
| 4,834,826 | 5/1989 | Abe et al. | 156/344 |
| 4,956,033 | 9/1990 | Martin et al. | 156/94 |
| 5,123,993 | 6/1992 | Wiggins | 156/584 |

*Primary Examiner*—Steven O. Douglas
(74) *Attorney, Agent, or Firm*—Howard & Howard

(57) ABSTRACT

A loading mechanism is disclosed for loading bottles (14) onto a turret (12) and includes a screw (22), a linear conveyor (24), a pair of star wheels (26 and 28), and a drive. The assembly is characterized by a groove in the screw (22) having a cross section with a narrow throat (30) for engaging a neck (16) of the bottle (14) and a larger portion (32) above the throat (30) for establishing a space about the neck (16) of the bottle (14) spaced therein by the narrow throat (30). A pair of opposing lips (34) are spaced apart to define the throat (30) and a pair of spaced side walls (36) extend into the screw (22) from the lips (34) to a bottom wall (38), which remain out of contact with the neck (16) of the bottles (14).

10 Claims, 3 Drawing Sheets

BOTTLE FILLING ASSEMBLY WITH A SCREW LOADER HAVING A SPATIAL GROOVE

BACKGROUND OF THE INVENTION

1. Field of the Invention

The subject invention relates to a bottle-container filling machine of the type utilizing a feed screw to feed bottles to the filling assembly.

2. Description of the Prior Art

Such bottle container filling assemblies include a turret for moving containers having a neck presenting an open mouth in a filling path and a loading mechanism for loading containers onto the turret. In many instances the loading mechanism includes a screw having a groove for engaging the neck of containers to space and move the containers along a loading path. Examples of these assemblies are disclosed in U.S. Pat. No. 3,771,574 to Creed et al and 5,123,993 to Wiggins.

However, for various reasons including reducing friction and enhances sanitation, it is desirable to minimize the contact between the screw and the neck of the of the containers.

SUMMARY OF THE INVENTION AND ADVANTAGES

A container filling assembly comprising a turret for moving containers having a neck presenting an open mouth in a filling path and a loading mechanism for loading containers onto the turret. The loading mechanism includes a screw having a groove for engaging the neck of containers to space and move the containers along a loading path. The assembly is characterized by the groove in the screw having a narrow throat for engaging the neck of a container and a larger portion above the throat for establishing a space about the neck of a container spaced therein by the narrow throat.

Accordingly, the subject invention provides a screw, which minimizes contact with the neck of the bottle containers thereby reducing friction and enhancing sanitation.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
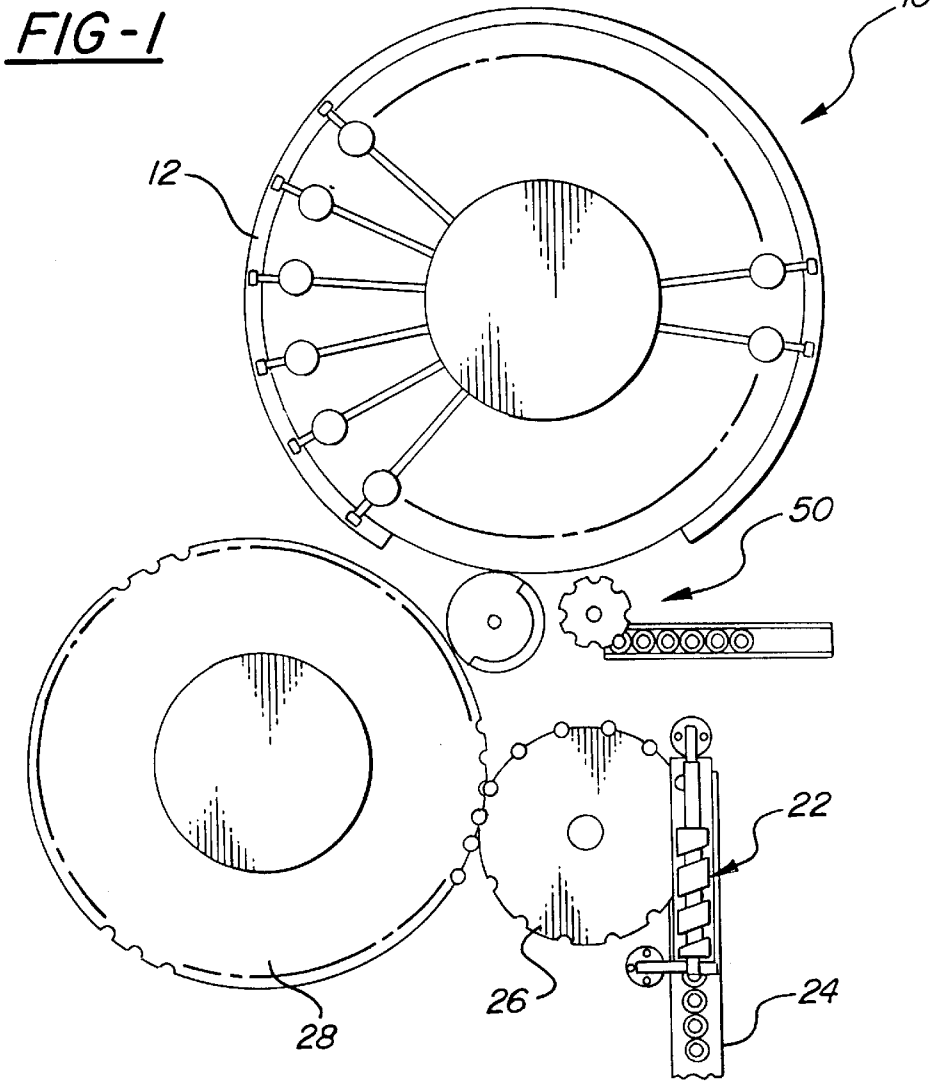
FIG. 1 is a plan view of a container filling assembly incorporating the screw conveyor of the subject invention.
Figure 2:
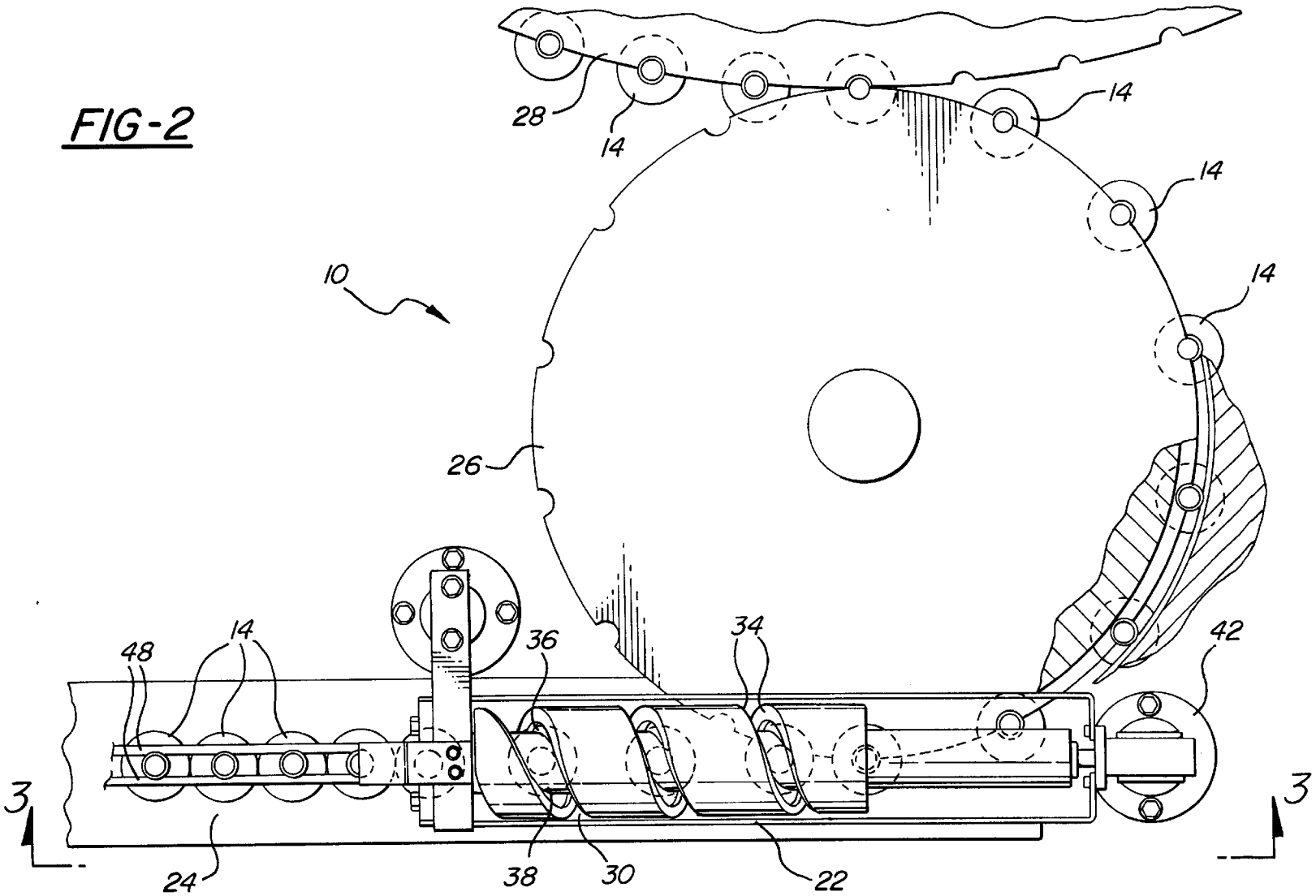
FIG. 2 is a fragmentary plan view of the screw conveyor of the subject invention.

Referring to the Figures, wherein like numerals indicate like or corresponding parts throughout the several views, a container filling assembly is generally shown at 10 in FIGS. 1 and 2.

The assembly 10 includes a circular turret 12 for moving containers 14 having a neck 16 presenting an open mouth in a circular filling path as the turret 12 rotates, as is well known in the art. The containers 14 include threads 18 about the neck 16 and a neck ring 20 below the threads 18.

A loading mechanism is included for loading containers 14 onto the turret 12 and includes a screw generally indicated at 22, a linear conveyor 24, a pair of star wheels 26 and 28, and a drive. The drive rotates the screw 22 and the turret 12 and the star wheels 26 and 28 in proportion to one another for dispensing containers 14 from the screw 22 into the first star wheel 26 and from the star wheel 28 into the turret 12, as well known in the art. The linear conveyor 24 supplies containers 14 the screw 22. The star wheels 26 and 28 have a plurality of evenly spaced pockets disposed circumferentially thereabout for receiving containers 14 from the screw 22 and transferring the containers 14 to the filling turret 12. Preferably, star wheel 28 is a precleaning station as is well known in the art.

Figure 4:
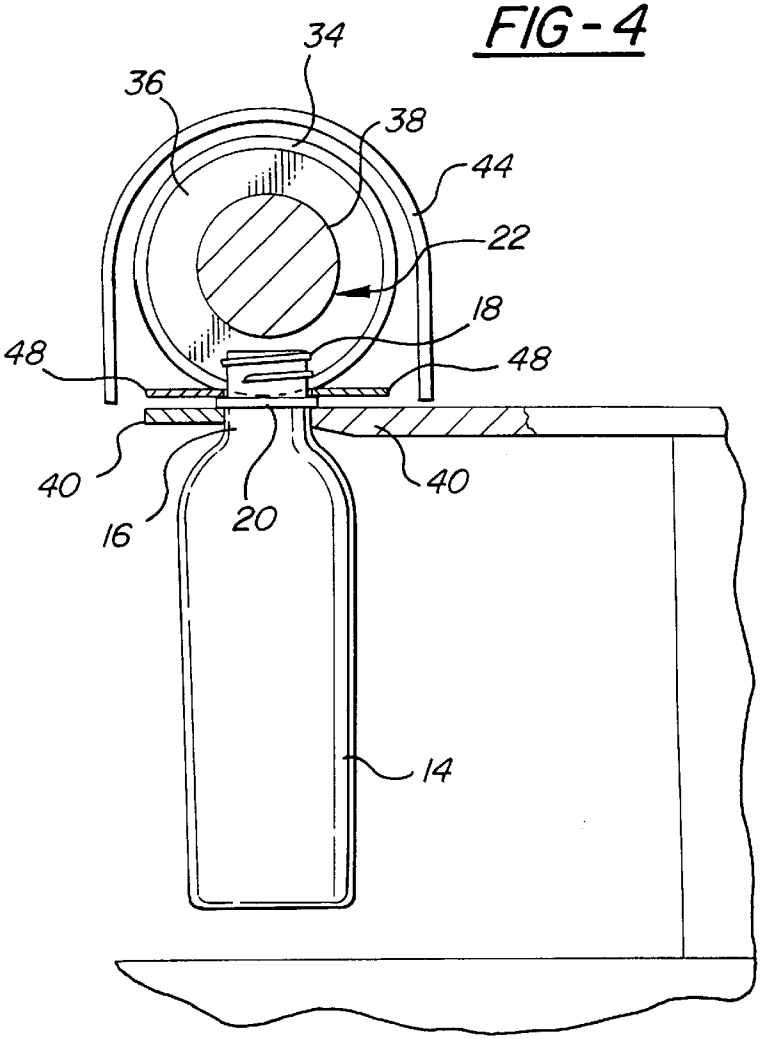
FIG. 4 is a fragmentary cross sectional view taken along line 4—4 of FIG. 3.
Figure 3:
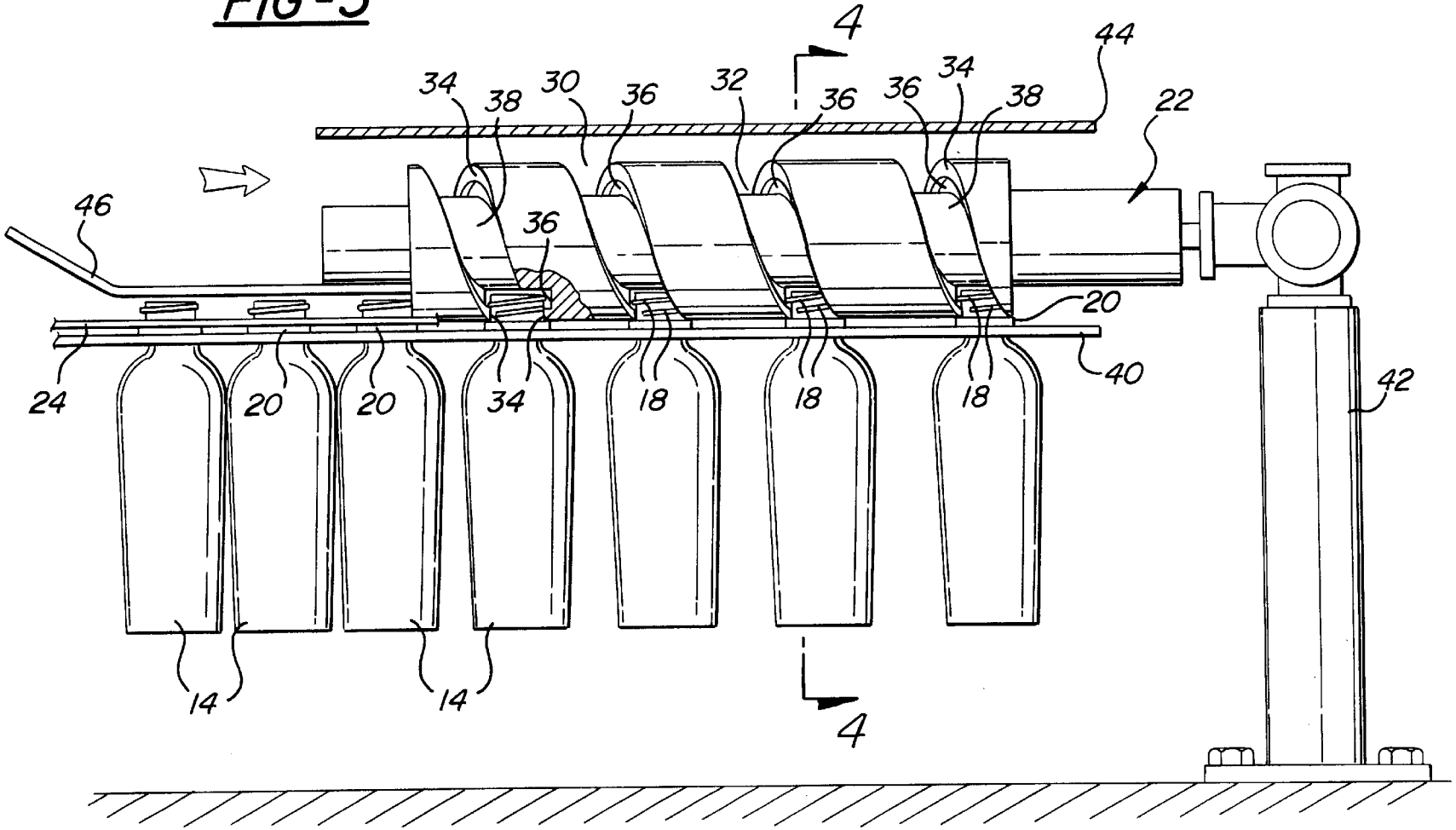
FIG. 3 is a side elevational view taken along line 3—3 of FIG. 2.

As also shown in FIGS. 3 and 4, the screw 22 has a groove extending helically thereabout for engaging the neck 16 of the containers 14 to space and move the containers 14 along a linear loading path. More specifically, the assembly is characterized by the groove in the screw 22 having a cross section with a narrow throat 30 for engaging the neck 16 of a container 14 and a larger portion 32 above the throat 30 for establishing a space about the neck 16 of a container 14 spaced therein by the narrow throat 30. The groove is further characterized by a pair of opposing lips 34 spaced apart to define the throat 30. And the larger portion 32 is further characterized by a pair of spaced side walls 36 extending into the screw 22 from the lips 34 and a bottom wall 38 interconnecting the side walls 36.

A support is included for supporting the containers 14 with the necks 16 thereof in the groove. In other words, the support is spaced from the screw 22 a distance to space the open mouth of the containers 14 from the bottom wall 38 of the groove whereby the lips 34 guide the necks 16 of the containers 14 while the mouths and adjacent portion 32 of the necks 16 remain out of contact with the screw 22. The support comprises a pair of flanges 40 defining a slot for engaging said neck ring 20 to position the necks 16 of the containers 14 in the groove.

A stanchion 42 supports the screw 22 and houses the drive for rotating the screw 22. A cover 44 covers the screw 22. A guide 46 guides the open mouths of the bottle containers 14 so that the rings 20 are urged down against the flanges 40 and rails 48 guide the necks 16 into the groove of the screw 22. A transfer system 50 conveys the filled bottles 14 from the turret 12. The rotating screw 22 picks up the neck 16 of each successive bottle 14 presented by the linear conveyor 24; however, the open mouth of the bottle and the upper portion of the neck 16 remains free of contact by the screw 22 as the helical lips 34 of the groove move the bottles along the loading path from which they are picked up by the spaced pockets of the star wheel 26.

Obviously, many modifications and variations of the present invention are possible in light of the above teachings. The invention may be practiced otherwise than as specifically described within the scope of the appended claims, wherein that which is prior art is antecedent to the novelty set forth in the "characterized by" clause. The novelty is meant to be particularly and distinctly recited in the "characterized by" clause whereas the antecedent recitations merely set forth the old and well-known combination in which the invention resides. These antecedent recitations should be interpreted to cover any combination in which the incentive novelty has utility. In addition, the reference numerals are merely for convenience and are not to be in any way to be read as limiting.

What is claimed is:

1. A container filling assembly comprising;

a turret (12) for moving containers (14) each having a neck (16) presenting an open mouth in a filling path, a loading mechanism for loading containers (14) onto the turret (12), said loading mechanism including a screw (22) having a groove for engaging each neck (16) of the containers (14) to space and move the containers (14) along a loading path, said assembly characterized by said groove in said screw (22) having a narrow throat (30) for engaging each neck (16) of the containers (14) and a larger portion (32) above said throat (30) for establishing a space about the necks (16) of the containers (14) spaced therein by said narrow throat (30).

2. An assembly as set forth in claim 1 including a support for supporting the containers (14) with the necks (16) thereof in said groove.

3. An assembly as set forth in claim 2 wherein said groove is further characterized by a pair of opposing lips (34) spaced apart to define said throat (30).

4. An assembly as set forth in claim 3 wherein said larger portion (32) is further characterized by a pair of spaced side walls (36) extending into said screw (22) from said lips (34) and a bottom wall (38) interconnecting said side walls (36).

5. An assembly as set forth in claim 4 wherein said support is spaced from said screw (22) a distance to space the open mouth of the containers (14) from said bottom wall (38) of said groove whereby said lips (34) guide the necks (16) of the containers (14) while the mouths and adjacent portion (32) of the necks (16) remain out of contact with said screw (22).

6. An assembly as set forth in claim 5 wherein the containers (14) include threads (18) about the neck (16) and a neck ring (20) below the threads (18) and said support comprises a pair of flanges (40) defining a slot for engaging said neck ring (20) to position the necks (16) of the containers (14) in said groove.

7. An assembly as set forth in claim 6 wherein said loading mechanism includes a star wheel having a plurality of evenly spaced pockets disposed circumferentially thereabout for receiving containers (14) from said screw (22).

8. An assembly as set forth in claim 7 wherein said loading mechanism includes a linear conveyor (24) for supplying containers (14) to said groove in said screw (22).

9. An assembly as set forth in claim 8 wherein said loading mechanism includes a drive for rotating said screw (22).

10. An assembly as set forth in claim 8 wherein said turret (12) is circular and said loading mechanism includes a drive for rotating said screw (22) and said turret (12) and said star wheel in proportion (32) to one another for dispensing containers (14) from said groove into said star wheel and from said star wheel into said turret (12).

* * * * *